US010544987B2

(12) United States Patent
Takezawa et al.

(10) Patent No.: US 10,544,987 B2
(45) Date of Patent: Jan. 28, 2020

(54) GAS LIQUEFACTION PLANT

(71) Applicant: JGC CORPORATION, Tokyo (JP)

(72) Inventors: Naoyuki Takezawa, Kanagawa (JP); Shigeru Akiyama, Kanagawa (JP); Yoshihisa Wakamatsu, Kanagawa (JP)

(73) Assignee: JGC CORPORATION, Yokohama (JP)

( * ) Notice: Subject to any disclaimer, the term of this patent is extended or adjusted under 35 U.S.C. 154(b) by 275 days.

(21) Appl. No.: 15/323,435

(22) PCT Filed: Mar. 5, 2015

(86) PCT No.: PCT/JP2015/001202
§ 371 (c)(1),
(2) Date: Jan. 3, 2017

(87) PCT Pub. No.: WO2016/024372
PCT Pub. Date: Feb. 18, 2016

(65) Prior Publication Data

US 2017/0160009 A1 Jun. 8, 2017

(30) Foreign Application Priority Data

Aug. 11, 2014 (JP) ..... 2014-163969

(51) Int. Cl.
*F25J 1/02* (2006.01)
*F25J 1/00* (2006.01)

(52) U.S. Cl.
CPC ..... *F25J 1/0259* (2013.01); *F25J 1/0022* (2013.01); *F25J 1/0216* (2013.01); *F25J 1/0283* (2013.01);
(Continued)

(58) Field of Classification Search
CPC ..... F25J 1/0212–0218; F25J 1/0257; F25J 1/0259
See application file for complete search history.

(56) References Cited

U.S. PATENT DOCUMENTS

2006/0150671 A1* 7/2006 Lijima ..... F25J 1/0022 62/612
2012/0067080 A1* 3/2012 Byfield ..... F25B 1/10 62/613
(Continued)

FOREIGN PATENT DOCUMENTS

JP 2005-147568 6/2005
RU 2353869 4/2009
(Continued)

OTHER PUBLICATIONS

"International Search Report (Form PCT/ISA/210) of PCT/JP2015/001202", dated Jun. 2, 2015, with English translation thereof, pp. 1-4.
(Continued)

*Primary Examiner* — Tareq Alosh
(74) *Attorney, Agent, or Firm* — JCIPRNET

(57) ABSTRACT

In a gas liquefaction plant that produces a liquefied gas by liquefying a raw gas, a pipe rack portion in which an air-cooling heat exchanging system is disposed has a rectangular shape when viewed from above. A first compressor, a precooling heat exchanging portion, an auxiliary heat exchanging portion, and a fourth compressor are arranged in this order along one long side of the pipe rack portion. A second compressor, a primary heat exchanging portion, and a third compressor are arranged in this order along the other long side of the pipe rack portion. A pipe that carries the raw gas cooled at the precooling heat exchanging portion is connected to the primary heat exchanging portion across the pipe rack portion. A pipe that carries a primary refrigerant compressed at the second and third compressors is connected to the auxiliary heat exchanging portion across the pipe rack portion.

6 Claims, 4 Drawing Sheets

(52) U.S. Cl.
CPC ..... *F25J 1/0292* (2013.01); *F25J 1/0294* (2013.01); *F25J 2220/64* (2013.01); *F25J 2220/66* (2013.01); *F25J 2220/68* (2013.01); *F25J 2270/60* (2013.01); *F25J 2270/66* (2013.01); *F25J 2290/42* (2013.01); *F25J 2290/60* (2013.01)

(56) References Cited

U.S. PATENT DOCUMENTS

| | | | | |
|---|---|---|---|---|
| 2012/0090351 | A1* | 4/2012 | Van De Lisdonk .... | F02C 7/143<br>62/613 |
| 2014/0053599 | A1 | 2/2014 | Byfield | |
| 2016/0010916 | A1* | 1/2016 | Byfield ..... | F25J 1/0022<br>62/611 |

FOREIGN PATENT DOCUMENTS

| | | |
|---|---|---|
| WO | 2012057626 | 5/2012 |
| WO | 2014048845 | 4/2014 |
| WO | 2014103332 | 7/2014 |

OTHER PUBLICATIONS

"Notice of allowance of Russia Counterpart Application", dated Jun. 22, 2018, with English translation thereof, p. 1-p. 21.

* cited by examiner

GAS LIQUEFACTION PLANT

CROSS-REFERENCE TO RELATED APPLICATION

This application is a 371 of international application of PCT application serial no. PCT/JP2015/001202, filed on Mar. 5, 2015, which claims the priority benefit of Japan application no. 2014-163969, filed on Aug. 11, 2014. The entirety of each of the abovementioned patent applications is hereby incorporated by reference herein and made a part of this specification.

TECHNICAL FIELD

The present invention relates to a facility for producing a liquefied gas by liquefying a raw gas.

BACKGROUND ART

The process of producing a liquefied natural gas includes a step of preprocessing a natural gas, such as removal of acid gas and water, a subsequent step of preliminarily cooling the natural gas to, for example, approximately −40° C. using a precooling refrigerant, and a subsequent step of removing a heavy gas from the natural gas and liquefying the natural gas by cooling the gas to a temperature within the range of, for example, −155° C. to −158° C. using a primary refrigerant. Examples usable as a precooling refrigerant include a refrigerant containing propane as a main component, and examples usable as a primary refrigerant include a mixed refrigerant containing a mixture of methane, ethane, propane, and nitrogen.

These refrigerants are circulated in a vapor compression refrigeration cycle. In the refrigeration cycle, the refrigerants in gaseous form are compressed by a compressor and then cooled and liquefied by a condenser. The liquefied high-pressure refrigerants have their pressures and temperatures reduced by, for example, expansion valves or expansion turbines. The low-temperature refrigerants are gasified again into a gas by exchanging heat with the natural gas. The precooling refrigerant is also used to cool a primary refrigerant compressed by the compressor. After cooled by the precooling refrigerant, the primary refrigerant exchanges heat with the natural gas.

Patent Literature 1 describes such a gas liquefaction plant in which the following devices are disposed on one side of a pipe rack forming a pipe assembly: a precooling heat exchanging system using a first refrigerant (precooling refrigerant), a first refrigerant compressor that compresses the first refrigerant, a very-low-temperature heat exchanging system using a second refrigerant (primary refrigerant), and a second refrigerant compressor that compresses the second refrigerant.

Industrial gas turbines as large as, for example, 80 MW have been used as compressor driving sources. On the other hand, high-performance efficient smaller gas turbines of, for example, 25 MW to 60 MW, originally developed for airplanes, have recently been developed. The inventors assume that the use of multiple smaller gas turbines would enhance the design freedom.

The use of multiple smaller gas turbines in the layout disclosed in Patent Literature 1, however, makes the piping arrangement complex, requiring a wide space and increasing the size of the gas liquefaction plant.

Patent Literature 2 describes the technology involving multiple compressors driven by respective gas turbines in the refrigeration cycle for liquefying a natural gas, but does not disclose the technology for solving the problem confronted by the inventors.

CITATION LIST

Patent Literature

[Patent Literature 1] Japanese Unexamined Patent Application Publication No. 2005-147568

[Patent Literature 2] International Publication No. 2014/48845

SUMMARY OF INVENTION

Technical Problem

The present invention was made against this background and aims to provide a technology for simplifying a piping arrangement and minimizing an installation space for a gas liquefaction plant including multiple compressors respectively used in a refrigeration cycle that preliminarily cools a raw gas and in a refrigeration cycle that liquefies the preliminarily cooled raw gas.

Solution to Problem

A gas liquefaction plant that produces a liquefied gas by liquefying a raw gas includes: a pipe rack portion that has a rectangular shape when viewed from above, that holds a pipe assembly, and in which an air-cooling heat exchanging system that cools a fluid in a pipe with air is disposed; a precooling heat exchanging portion that preliminarily cools the raw gas by expanding a compressed precooling refrigerant; a first compressor that compresses the precooling refrigerant; a primary heat exchanging portion that cools and liquefies the raw gas precooled at the precooling heat exchanging portion by expanding a compressed primary refrigerant; a second compressor and a third compressor that individually compress the primary refrigerant subjected to heat exchange at the primary heat exchanging portion; an auxiliary heat exchanging portion that cools the primary refrigerant compressed at the second compressor and the third compressor by expanding the compressed precooling refrigerant; and a fourth compressor that compresses the precooling refrigerant. The first compressor, the precooling heat exchanging portion, the auxiliary heat exchanging portion, and the fourth compressor are arranged in this order along a long side of the pipe rack portion outside the pipe rack portion. The second compressor, the primary heat exchanging portion, and the third compressor are arranged in this order along the other long side of the pipe rack portion outside the pipe rack portion. A pipe that carries the precooling refrigerant subjected to heat exchange at the precooling heat exchanging portion and a pipe that carries the precooling refrigerant subjected to heat exchange at the auxiliary heat exchanging portion are combined into one pipe and the combined pipe bifurcates into pipes connected to the first compressor and the fourth compressor. A pipe that carries the precooling refrigerant compressed at the first compressor and a pipe that carries the precooling refrigerant compressed at the fourth compressor are combined into one pipe and the combined pipe bifurcates into pipes connected to the precooling heat exchanging portion and the auxiliary heat exchanging portion. A pipe that carries the raw gas cooled at the precooling heat exchanging portion is connected to the primary heat exchanging portion across the pipe rack portion. A pipe that carries the primary refrigerant compressed at the second compressor and the third compressor is connected to the auxiliary heat exchanging portion across the pipe rack portion.

The gas liquefaction plant may have the following features:

(a) a plurality of the first compressors is disposed. A plurality of the second compressors and a plurality of the third compressors are disposed, respectively. A plurality of the fourth compressors is disposed.

(b) a pipe that carries the primary refrigerant compressed at the second compressor and a pipe that carries the primary refrigerant compressed at the third compressor are combined into one pipe, and the combined pipe is connected to the auxiliary heat exchanging portion.

(c) pipes are arranged so that the raw gas is fed from a short side of the pipe rack portion and sent out from the other short side of the pipe rack portion. A preprocessing portion is disposed outside the pipe rack portion along a row of the second compressor, the primary heat exchanging portion, and the third compressor at a position adjacent to the short side, and the preprocessing portion processes the raw gas before the raw gas is precooled at the precooling heat exchanging portion.

(d) the primary heat exchanging portion, and at least one of the precooling heat exchanging portion and the auxiliary heat exchanging portion overlap at least partially when viewed in a direction in which short sides of the pipe rack portion extend.

Advantageous Effects of Invention

In the present invention, a precooling heat exchanging portion that preliminarily cools a raw gas and an auxiliary heat exchanging portion that cools a primary refrigerant are disposed on one side of a pipe rack portion that holds a pipe assembly. In addition, compressors that compress in cooperation (concurrently) a precooling refrigerant subjected to heat exchange at these heat exchanging portions are disposed on both sides of these heat exchanging portions. On the other side of the pipe rack portion, a primary heat exchanging portion that liquefies the preliminarily-cooled raw gas is disposed. Multiple compressors that compress the primary refrigerant subjected to heat exchange at the primary heat exchanging portion are disposed on each of both sides of the primary heat exchanging portion. Thus, the piping arrangement can be prevented from becoming complex and the installation space of the gas liquefaction plant can be minimized while multiple compressors are used for a refrigeration cycle.

DESCRIPTION OF EMBODIMENT

A facility for producing a liquefied natural gas (LNG), or a gas liquefaction plant, according to an embodiment of the present invention is described now.

Figure 1:
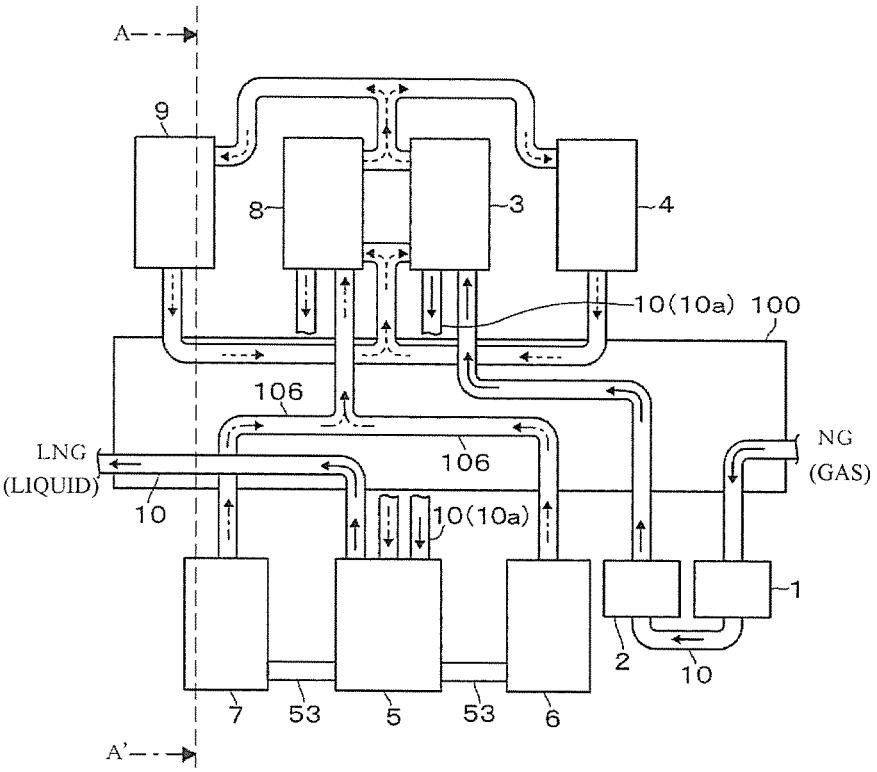
FIG. 1 is a schematic plan view of a LNG producing facility according to an embodiment of the present invention when viewed from above.

Firstly, referring to the plan view of FIG. 1, a schematic configuration of the LNG producing facility is described.

The description is given in order in which a natural gas (hereinafter referred to as a "NG") is processed. A LNG producing facility includes an acid gas removing portion 1, a water removing portion 2, a precooling heat exchanging portion 3, and a liquefaction portion 5. The acid gas removing portion 1 removes an acid gas from a NG, which is a raw gas. The water removing portion 2 removes water from the NG. The precooling heat exchanging portion 3 preliminarily cools the NG subjected to preprocessing of acid gas removal and water removal and cools the resultant NG to a temperature within the range of approximately −20° C. to −70° C., for example, to an intermediate temperature within the range of −38° C. to −39° C. A gas-liquid mixture cooled to the intermediate temperature is transmitted to a heavy-component removing portion, not illustrated, to remove heavy components heavier than or equal to compounds of the carbon number 2 (ethane and compounds heavier than ethane), and then the NG containing methane as a main component and some amount of ethane, propane, and butane is cooled to a temperature within the range of −155° C. to −158° C. to be liquefied to obtain a LNG, which is a liquefied gas by the liquefaction portion 5.

Here, a process piping 10 illustrated in FIG. 1 is a piping through which a raw material NG or a product LNG passes. The acid gas removing portion 1 and the water removing portion 2 correspond to a preprocessing portion of a LNG producing facility according to an embodiment.

The precooling heat exchanging portion 3 precools the NG subjected to preprocessing by using, for example, propane (referred to as "C3" in FIG. 2), which is a precooling refrigerant. This precooling refrigerant is also used at the subsequent liquefaction portion 5 to cool a primary refrigerant (written as "MR", meaning mixed refrigerant, in FIG. 2 and FIG. 3). Hereinbelow, the operation performed by the precooling refrigerant to cool the primary refrigerant is referred to as "auxiliary cooling".

Figure 2:
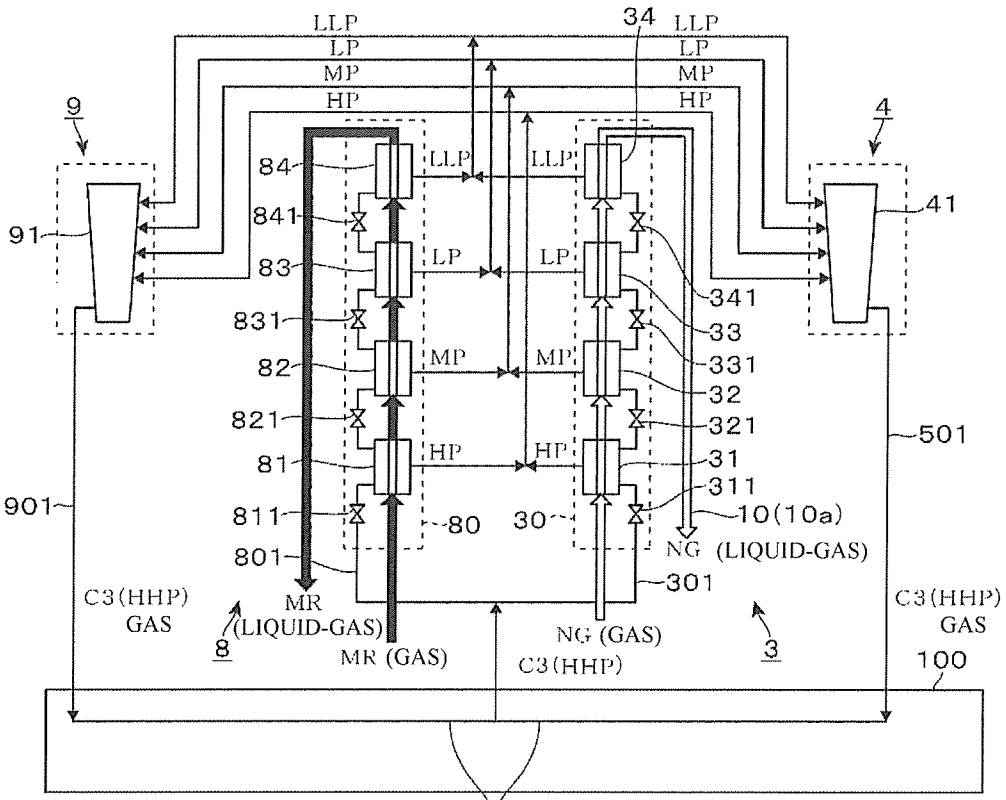
FIG. 2 is a block diagram of a configuration of a precooling heat exchanging portion and an auxiliary heat exchanging portion included in the LNG producing facility.

FIG. 2 illustrates the precooling heat exchanging portion 3, described above, an auxiliary heat exchanging portion 8, which cools the primary refrigerant, and a first compressor 4 and a fourth compressor 9, which compress these precooling refrigerants that have finished precooling the NG and preliminarily cooling the primary refrigerant.

The precooling heat exchanging portion 3 includes multiple heat exchanging systems. FIG. 2 shows only a single heat exchanging system 30 as an example. Each heat exchanging system 30 includes, for example, four heat exchanging elements 31, 32, 33, and 34 connected in series. In this description, in order to be distinguished from the "heat exchanging systems", those connected in series are referred to as "heat exchanging elements". The heat exchanging element 31 does not have to be disposed in each heat exchanging system 30.

A precooling refrigerant fed from a precooling-refrigerant feed pipe 301 to the heat exchanging system 30 passes through the heat exchanging elements 31, 32, 33, and 34 connected in series in this order, and cools the NG similarly passing through the tubes of the heat exchanging elements 31, 32, 33, and 34 in this order by exchanging heat with the NG. Expansion valves 311, 321, 331, and 341 are respectively provided at the inlets of the heat exchanging elements 31, 32, 33, and 34. Adiabatic expansion of the precooling refrigerant is caused at these expansion valves 311, 321, 331, and 341 to reduce the temperature of the precooling refrigerant and thus to gradually reduce the temperature of the NG at the outlets of the heat exchanging elements 31, 32, and 33.

Consequently, at the outlet of the last heat exchanging element 34 (the outlet of the heat exchanging system 30), the NG in the gas-liquid mixed form cooled to a temperature within the range of, for example, −37° C. to −40° C., preferably, −38° C. to −39° C. is obtained.

Part of the precooling refrigerant that has finished cooling the NG is pulled out from the heat exchanging elements 31, 32, and 33. In FIG. 2, in accordance with the pressure level of the refrigerant at the outlets of the heat exchanging elements 31, 32, and 33, reference symbols are attached to the corresponding pipes: the reference symbol "HP", meaning high pressure, is attached to the pipe that carries part of the precooling refrigerant pulled out from the heat exchanging element 31. The reference symbol "MP", meaning middle pressure, is attached to the pipe that carries part of the precooling refrigerant pulled out from the heat exchanging element 32. The reference symbol "LP", meaning low pressure, is attached to the pipe that carries part of the precooling refrigerant pulled out from the heat exchanging element 33. The reference symbol "LLP", meaning low low pressure, is attached to the pipe that carries part of the precooling refrigerant at the outlet of the last heat exchanging element 34.

Subsequently, the configuration of an auxiliary heat exchanging portion 8 that performs an auxiliary cooling of the primary refrigerant is described. The auxiliary heat exchanging portion 8 has substantially the same configuration as the precooling heat exchanging portion 3 described above, except that a fluid that is cooled is the primary refrigerant.

Specifically, a precooling refrigerant fed from a precooling-refrigerant feed pipe 801 to the heat exchanging system 80 passes through heat exchanging elements 81, 82, 83, and 84 connected in series in this order, and cools the primary refrigerant similarly passing through the tubes of the heat exchanging elements 81, 82, 83, and 84 in this order by exchanging heat with the primary refrigerant. Expansion valves 811, 821, 831, and 841 are respectively provided at the inlets of the heat exchanging elements 81, 82, 83, and 84. Adiabatic expansion of the precooling refrigerant is caused at these expansion valves 811, 821, 831, and 841 to reduce the temperature of the precooling refrigerant and thus to gradually reduce the temperature of the primary refrigerant at the outlets of the heat exchanging elements 81, 82, and 83. Thus, at the outlet of the last heat exchanging element 84 (the outlet of the heat exchanging system 80), the primary refrigerant cooled to a temperature within the range of, for example, −37° C. to −40° C., preferably, −38° C. to −39° C. is obtained.

Also similarly to the precooling heat exchanging portion 3, part of the precooling refrigerant that has finished cooling the primary refrigerant is pulled out from the heat exchanging elements 81, 82, and 83. In FIG. 2, in accordance with the pressure level of the precooling refrigerant at each portion, the same reference symbols that are attached to the pipes that carry the precooling refrigerant from the heat exchanging elements 31, 32, 33, and 34 of the precooling heat exchanging portion 3 are attached to the corresponding pipes that carry part of the precooling refrigerant pulled out from these heat exchanging elements 81, 82, and 83 and at the outlet of the last heat exchanging element 84.

Flows of the precooling refrigerant through pullout and outlet pipes continuous with the heat exchanging elements 31, 32, 33, and 34 of the precooling heat exchanging portion 3 and flows of the precooling refrigerant through pullout and outlet pipes continuous with the heat exchanging elements 81, 82, 83, and 84 of the auxiliary heat exchanging portion 8 join together in the following manner. Specifically, since pipes that carry flows of the precooling refrigerant having the same pressure level are combined together, flows of the precooling refrigerant having the same pressure level join together and pass through a common pipe toward the downstream side.

Here, a first compressor 4 and a fourth compressor 9, which compress the precooling refrigerant that has finished cooling the NG or the primary refrigerant, are respectively disposed on the side of the precooling heat exchanging portion 3 and on the side of the auxiliary heat exchanging portion 8 described above. In this embodiment, the first compressor 4 and the fourth compressor 9 are gas turbine compressors. The first compressor 4 and the fourth compressor 9 are rotated by a driving force obtained by burning a fuel gas at gas turbines, not illustrated, to compress the precooling refrigerant. For convenience of illustration, FIG. 2 shows one first compressor 4 and one fourth compressor 9. However, multiple first compressors 4 and multiple fourth compressors 9 may be provided in accordance with, for example, the number of heat exchanging systems 30 of the precooling heat exchanging portion 3 or the number of heat exchanging systems 80 of the auxiliary heat exchanging portion 8.

As illustrated in FIG. 2, flows of the precooling refrigerant that have joined together after ejected from the precooling heat exchanging portion 3 and the auxiliary heat exchanging portion 8, so as to have the same pressure level bifurcate into two flows toward the first compressor 4 and the fourth compressor 9 and then are fed to one of the stages corresponding to the pressure level. The precooling refrigerant is compressed in the first compressor 4 and the fourth compressor 9. The precooling refrigerant having its pressure increased up to a predetermined pressure is ejected from the first compressor 4 and the fourth compressor 9 in gaseous form (denoted by "C3 (HHP) gas" in FIG. 2) and passes in gaseous form through compressor outlet pipes 501 and 901 to air-fin coolers (AFCs, 101) provided in a pipe rack portion 100, described below.

Thereafter, flows of the precooling refrigerant that have finished passing through the precooling refrigerant cooling pipe 103 cooled by the AFCs 101 change into liquid form and join together and pass through a precooling refrigerant joint pipe 104 (denoted by "C3 (HHP) liquid" in FIG. 2). After passing through the precooling refrigerant joint pipe 104, the precooling refrigerant bifurcates into flows passing through precooling-refrigerant feed pipes 301 and 801 and the flows are then fed to the precooling heat exchanging portion 3 and the auxiliary heat exchanging portion 8.

Figure 3:
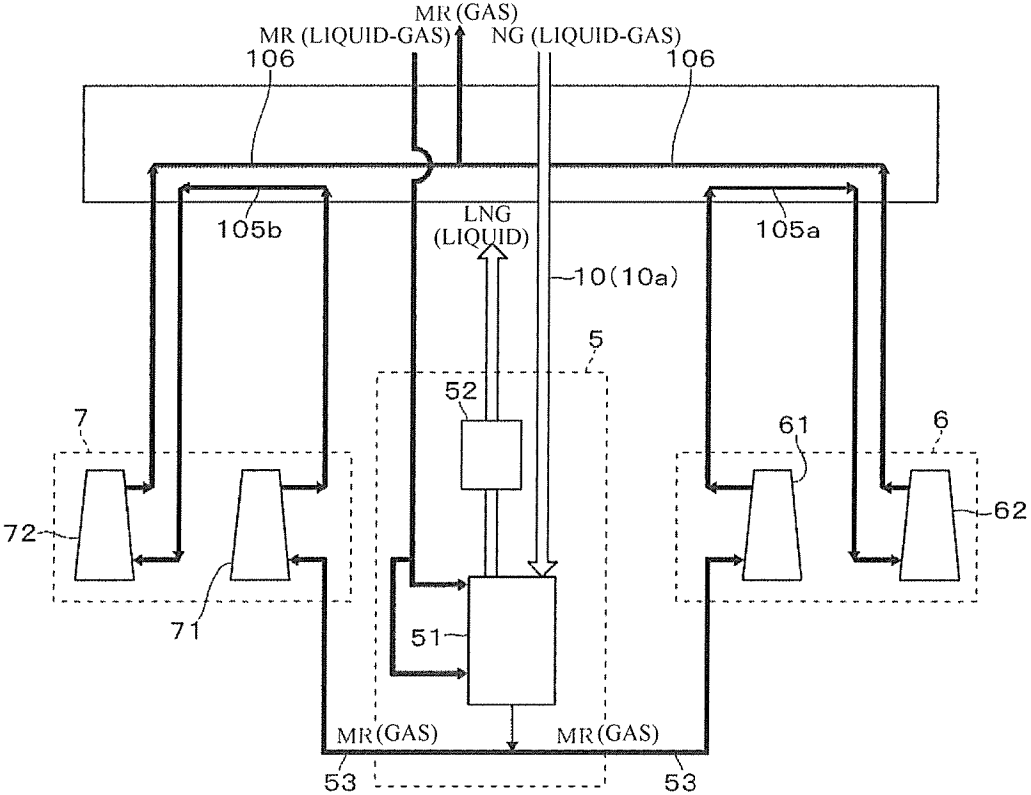
FIG. 3 is a block diagram of a configuration of a liquefaction portion and compressors included in the LNG producing facility.

Referring now to FIG. 3, the configuration of a liquefaction portion 5 and a second compressor 6 and a third compressor 7, which compress a primary refrigerant that has finished liquefying the NG at the liquefaction portion 5, is described.

The liquefaction portion 5 liquefies the precooled NG using a mixed refrigerant (MR) including, for example, nitrogen, methane, ethane, and propane as a primary refrigerant.

The liquefaction portion 5 includes: a heat exchanging system 51, serving as a primary heat exchanging portion; a LNG refining facility 52, which causes a liquefied LNG to flash for impurity removal or pressure adjustment; and a reliquefaction portion, which reliquefies the liquefied LNG by separating a gas from the liquefied LNG. In FIG. 3, for convenience of illustration, the reliquefaction portion is not illustrated although the heat exchanging system 51 and the LNG refining facility 52 are illustrated. Alternatively, multiple heat exchanging systems 51 or multiple LNG refining facilities 52 may be provided. In this embodiment, one heat exchanging system 51 and one LNG refining facility 52 are described as examples.

The primary refrigerant that has caused adiabatic expansion using expansion valves or expansion turbines, not illustrated, is introduced in several stages into the heat exchanging system 51 including tubes through which the precooled NG fed from the precooling heat exchanging portion 3 passes. The temperature of the introduced primary refrigerant is reduced stepwise in stages by auto-refrigeration. Consequently, the NG that passes through the tubes is cooled stepwise and a LNG having a temperature in the range of −155° C. to −158° C. is finally obtained. This LNG is refined and subjected to pressure adjustment at the LNG refining facility 52 and then transmitted to a LNG storage facility or a delivery facility as a LNG product of −160° C.

Furthermore, the primary refrigerant that has finished liquefying the LNG flows out in gaseous form from the heat exchanging system 51 (denoted by "MR (gas)" in FIG. 3).

A second compressor 6 and a third compressor 7, which compress the primary refrigerant that has finished liquefying the LNG, are disposed on the sides to the liquefaction portion 5. In this embodiment, the second compressor 6 and the third compressor 7 are gas turbine compressors. The second compressor 6 and the third compressor 7 are rotated by a driving force obtained by burning a fuel gas at gas turbines, not illustrated, to compress the primary refrigerant. The second compressor 6 includes two compressors 61 and 62 that respectively perform low-pressure compression and high-pressure compression and that are connected in series with an intermediate cooling pipe 105*a*, cooled by AFCs 101, interposed therebetween. Similarly to the second compressor 6, the third compressor 7 includes two compressors 71 and 72 that are connected in series with an intermediate cooling pipe 105*b*, cooled by AFCs 101, interposed therebetween. For convenience of illustration, FIG. 3 only illustrates one second compressor 6 and one third compressor 7. However, multiple second compressors 6 and multiple third compressors 7 are actually provided corresponding to the number of heat exchanging systems 51 of the liquefaction portion 5.

The primary refrigerant that has flowed out of the heat exchanging system 51 bifurcates into two flows passing through a primary-refrigerant bifurcating pipe 53 toward the second compressor 6 and the third compressor 7 and the flows are then fed to the compressors 61 and 71 that perform low-pressure compression. The primary refrigerant compressed in the compressors 61 and 71 and subjected to pressure rising up to a predetermined pressure is ejected in gaseous form from the compressors 61 and 71, passes through the intermediate cooling pipes 105*a* and 105*b* of the pipe rack portion 100, and is cooled by AFCs 101.

The cooled primary refrigerant is fed to the compressors 62 and 72 of the second compressor 6 and the third compressor 7 that perform high-pressure compression and subjected to pressure rising up to a predetermined pressure. Then, the primary refrigerant ejected from the compressors 62 and 72 passes in gaseous form through a primary-refrigerant cooling pipe 106 of the pipe rack portion 100 and is cooled by AFCs 101. Then, flows of the primary refrigerant are joined together and fed to the auxiliary heat exchanging portion 8, described above, in gaseous form.

Figure 4:
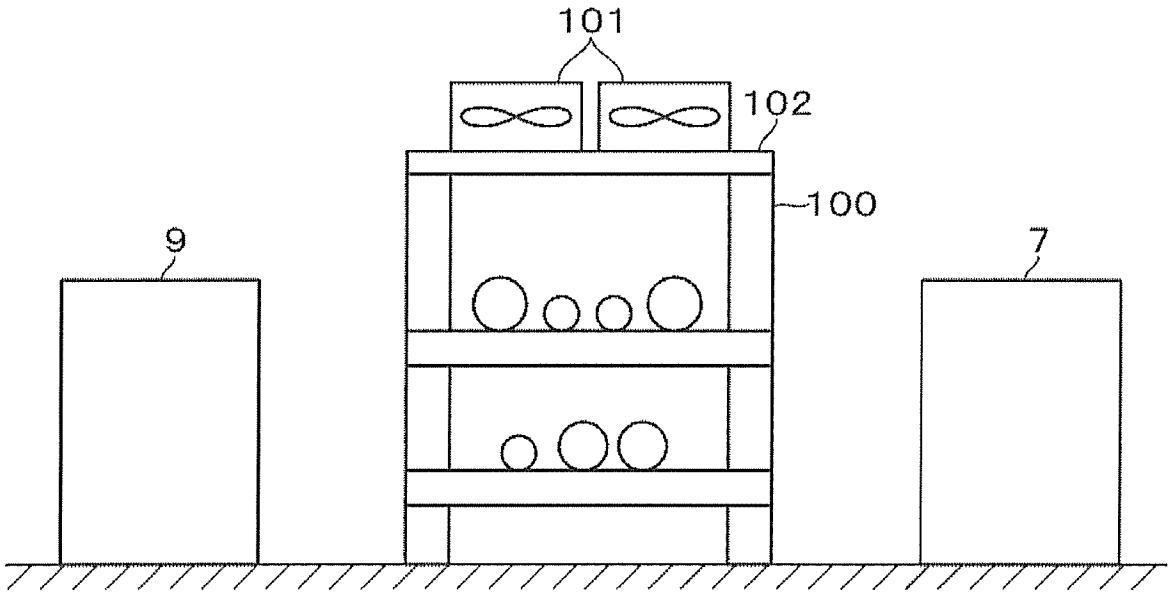
FIG. 4 is a schematic side view of the structure of a pipe rack in the LNG producing facility when taken vertically.

FIG. 4 is a side view of a LNG producing facility according to an embodiment taken along the line A-A' and viewed in the direction of arrows of FIG. 1. The pipe rack portion 100 includes multiple layers of stacking frameworks that support pipes connected to devices in the LNG producing facility (FIG. 4 illustrates an example of two layers of stacking frameworks). Air fin coolers (air-cooling heat exchanging systems or AFCs) 101 are disposed on top of the layer that supports these pipes.

The AFCs 101 are disposed on the upper or lower surface of a tube bundle 102, which is a pipe assembly through which a fluid that is to be cooled passes (FIG. 4 illustrates the case where the AFCs 101 are disposed on the upper surface of the tube bundle 102). The AFCs 101 cool a fluid passing through the pipes as a result of rotating fins and forming airflow around the pipes in the tube bundle 102.

Pipes constituting the tube bundle 102 include the above-described precooling refrigerant cooling pipe 103 through which the above-described precooling refrigerant passes and the intermediate cooling pipes 105*a* and 105*b* and the primary-refrigerant cooling pipe 106 through which a primary refrigerant passes. The precooling refrigerant cooled by the AFCs 101 is fed to the precooling heat exchanging portion 3 and the auxiliary heat exchanging portion 8. The primary refrigerant cooled by the AFCs 101 is fed to the auxiliary heat exchanging portion 8.

As illustrated in FIG. 1, when viewed from above, the pipe rack portion 100 has a thin rectangular shape that is long in the transverse direction of FIG. 1. Multiple AFCs 101 are arranged along the long side of the pipe rack portion 100.

In the LNG producing facility having the above-described configuration, as illustrated in FIG. 1, the first compressor 4, the precooling heat exchanging portion 3, the auxiliary heat exchanging portion 8, and the fourth compressor 9 are arranged in this order along one long side of the pipe rack portion 100 outside the pipe rack portion 100. For example, in FIG. 1, the first compressor 4, the precooling heat exchanging portion 3, the auxiliary heat exchanging portion 8, and the fourth compressor 9 are arranged in this order from the right.

On the other hand, the second compressor 6, the liquefaction portion 5 (the heat exchanging system 51 serving as a primary heat exchanging portion), and the third compressor 7 are arranged in this order along the other long side of the pipe rack portion 100 outside the pipe rack portion 100. For example, in FIG. 1, the second compressor 6, the liquefaction portion 5, and the third compressor 7 are arranged in this order from the right.

Furthermore, the liquefaction portion 5 (heat exchanging system 51) and at least one of the precooling heat exchanging portion 3 and the auxiliary heat exchanging portion 8 overlap at least partially when viewed in the direction in which the short sides of the pipe rack portion 100 extend. In other words, the liquefaction portion 5 and at least one of the precooling heat exchanging portion 3 and the auxiliary heat exchanging portion 8 are arranged opposite each other with the pipe rack portion 100 interposed therebetween.

The process piping 10 (denoted by "10*a*" in FIG. 1) that carries the NG cooled at the precooling heat exchanging portion 3 is connected to the heat exchanging system 51 of the liquefaction portion 5 across the pipe rack portion 100. The pipe (the primary-refrigerant cooling pipe 106 in FIG. 1 and FIG. 3) that carries the primary refrigerant compressed at the second compressor 6 and the third compressor 7 is connected to the auxiliary heat exchanging portion 8 across the pipe rack portion 100.

Piping is arranged so that the NG is fed from one short side of the pipe rack portion 100 (the right side in FIG. 1) and sent out from the other short side of the pipe rack portion 100 (the left side in FIG. 1). Here, the acid gas removing portion 1 and the water removing portion 2, which constitute a preprocessing portion, are disposed outside the pipe rack portion along the row of the second compressor 6, the liquefaction portion 5 (the heat exchanging system 51), and the third compressor 7 at a position adjacent to the one short side of the pipe rack portion 100 from which the NG is fed.

The heavy-component removing portion described above is disposed in, for example, the liquefaction portion 5.

A LNG producing facility according to an embodiment has the following effects. The LNG producing facility includes a precooling heat exchanging portion 3, which preliminarily cools a NG, and an auxiliary heat exchanging portion 8, which cools a primary refrigerant, on one side of the pipe rack portion 100 that holds a pipe assembly. The LNG producing facility also includes a first compressor 4 and a fourth compressor 9, which compress in cooperation (concurrently) the precooling refrigerant subjected to heat exchange at these heat exchanging portions 3 and 8, on both sides of the heat exchanging portions 3 and 8. The LNG producing facility also includes a heat exchanging system 51, which serves as a primary heat exchanging portion that liquefies a preliminarily-cooled raw gas, on the other side of the pipe rack portion 100. The LNG producing facility also includes multiple second compressors 6 and third compressors 7, which compress the primary refrigerant subjected to heat exchange at the heat exchanging system 51, on both sides of the heat exchanging system 51. Thus, the piping arrangement can be prevented from becoming complex while using multiple compressors 4, 9, 6, and 7 in a refrigeration cycle, whereby the space in which the gas liquefaction plant is installed can be minimized.

The primary-refrigerant bifurcating pipe 53 that conveys the primary refrigerant from the heat exchanging system 51 to the second compressor 6 and the third compressor 7 is a large-diameter pipe having a diameter of approximately 70 inches. Arranging the second compressor 6 and the third compressor 7 on both sides of the heat exchanging system 51 enables a shortening of the large-diameter pipe. On the other hand, the auxiliary heat exchanging portion 8 is disposed on one long side of the pipe rack portion 100, and the second compressor 6 and the third compressor 7 are disposed on the other long side of the pipe rack portion 100. Thus, a primary-refrigerant cooling pipe 106 having a relatively small diameter and through which a high-pressure fluid ejected from these compressors 6 and 7 passes crosses the pipe rack portion 100. Compared to the case where a large-diameter pipe crosses the pipe rack portion 100, an increase in height of the pipe rack portion 100 can be minimized.

In the above-described LNG producing facility, the force for driving the first compressor 4, the fourth compressor 9, the second compressor 6, and the third compressor 7 may be obtained by not only gas turbines, but also motors. The compressors are not limited to turbo compressors and may be reciprocating compressors.

What is claimed is:

1. A gas liquefaction plant that is configured to produce a liquefied gas by liquefying a raw gas, and the gas liquefaction plant is characterized in comprising:

a pipe rack portion that has a rectangular shape when viewed from above, that holds a pipe assembly, and in which an air-cooling heat exchanging system that is configured to cool a fluid in pipes of the pipe assembly with air is disposed;

a precooling heat exchanging portion that is configured to preliminarily cool the raw gas by expanding a compressed precooling refrigerant;

at least one first compressor that is configured to compress the precooling refrigerant;

a primary heat exchanging portion that is configured to cool and liquefies the raw gas precooled at the precooling heat exchanging portion by expanding a compressed primary refrigerant;

at least one second compressor and at least one third compressor that are configured to individually compress the primary refrigerant subjected to heat exchange at the primary heat exchanging portion;

an auxiliary heat exchanging portion that is configured to cool the primary refrigerant compressed at the at least one second compressor and the at least one third compressor by expanding the compressed precooling refrigerant; and at least one fourth compressor that is configured to compress the precooling refrigerant, wherein the at least one first compressor, the precooling heat exchanging portion, the auxiliary heat exchanging portion, and the at least one fourth compressor are arranged in this order along a long side of the pipe rack portion outside the pipe rack portion, wherein the at least one second compressor, the primary heat exchanging portion, and the at least one third compressor are arranged in this order along the other long side of the pipe rack portion outside the pipe rack portion, wherein a first pipe that is configured to carry the precooling refrigerant subjected to heat exchange at the precooling heat exchanging portion and a second pipe that is configured to carry the precooling refrigerant subjected to heat exchange at the auxiliary heat exchanging portion are combined into a first combined pipe, and the first combined pipe bifurcates into a third pipe and a fourth pipe, and the third pipe is connected to the at least one first compressor, and the fourth pipe is connected to the at least one fourth compressor, wherein a fifth pipe that is configured to carry the precooling refrigerant compressed at the at least one first compressor and a sixth pipe that is configured to carry the precooling refrigerant compressed at the at least one fourth compressor are combined into a second combined pipe, and the second combined pipe bifurcates into a seventh pipe and a eighth pipe, and the seventh pipe is connected to the precooling heat exchanging portion, and the eighth pipe is connected to the auxiliary heat exchanging portion, wherein a process piping that is configured to carry the raw gas cooled at the precooling heat exchanging portion is connected to the primary heat exchanging portion across the pipe rack portion, and wherein a primary-refrigerant cooling pipe that is configured to carry the primary refrigerant compressed at the at least one second compressor and the at least one third compressor is connected to the auxiliary heat exchanging portion across the pipe rack portion;

wherein a primary-refrigerant bifurcating pipe, that is configured to convey the primary refrigerant from the primary heat exchanging portion to the at least one second compressor and the at least one third compressor, is connected between the primary heat exchanging portion and the at least one second compressor, and is connected between the primary heat exchanging portion and the at least one third compressor.

2. The gas liquefaction plant according to claim 1, wherein the at least one first compressor comprises a plurality of first compressors.

3. The gas liquefaction plant according to claim 1, wherein the at least one second compressor comprises a plurality of second compressors, and the at least one third compressor comprises a plurality of third compressors.

4. The gas liquefaction plant according to claim 1, wherein the at least one fourth compressor comprises a plurality of fourth compressors.

5. The gas liquefaction plant according to claim 1, wherein a ninth pipe that is configured to carry the primary refrigerant compressed at the at least one second compressor and a tenth pipe that is configured to carry the primary refrigerant compressed at the at least one third compressor are combined into a third combined pipe, and the third combined pipe is connected to the auxiliary heat exchanging portion.

6. The gas liquefaction plant according to claim 1, wherein the primary heat exchanging portion, and at least one of the precooling heat exchanging portion and the auxiliary heat exchanging portion overlap at least partially when viewed in a direction in which short sides of the pipe rack portion extend.

* * * * *